US005596389A

United States Patent [19]

Dumas et al.

[11] Patent Number: 5,596,389

[45] Date of Patent: Jan. 21, 1997

[54] APPARATUS AND METHOD FOR SCHEDULING AN IMAGABLE SUBSTRATE AND A SPECIAL SHEET TO BE FED IN THE SAME PITCH

[75] Inventors: Glen A. Dumas, Henrietta; Michael E. Farrell, Ontario, both of N.Y.

[73] Assignee: Xerox Corporation, Stamford, Conn.

[21] Appl. No.: 353,970

[22] Filed: Dec. 12, 1994

[51] Int. Cl.[6] ..... G03G 21/00

[52] U.S. Cl. ..... 399/16; 399/364; 399/382

[58] Field of Search ..... 355/319, 321, 355/325, 309, 308, 204–207; 270/58, 59, 45, 46, 51; 271/298, 182, 285, 286, 291; 364/478

[56] References Cited

U.S. PATENT DOCUMENTS

| | | | |
|---|---|---|---|
| 4,248,525 | 2/1981 | Sterrett | 355/323 |
| 4,536,078 | 8/1985 | Ziehm | 355/314 |
| 4,561,772 | 12/1985 | Smith | 355/320 |
| 4,602,776 | 7/1986 | York et al. | 271/4.01 |
| 4,961,092 | 10/1990 | Rabb et al. | 355/323 |
| 5,095,342 | 3/1992 | Farrell et al. | 355/319 |
| 5,184,185 | 2/1993 | Rasmussen et al. | 355/308 |
| 5,272,511 | 12/1993 | Conrad et al. | 355/325 |
| 5,337,135 | 8/1994 | Malachowski et al. | 355/319 |
| 5,489,969 | 2/1996 | Soler et al. | 355/325 X |

OTHER PUBLICATIONS

John R. Yonovich, "Dual Function Sheet Feeder", *Xerox Disclosure Journal*, vol. 19, No. 4, Jul./Aug. 1994, pp. 333–336.

*Primary Examiner*—Shuk Yin Lee
*Attorney, Agent, or Firm*—Gary B. Cohen

[57] ABSTRACT

There is provided a scheduling apparatus for a printing system, the scheduling apparatus including a memory for storing a set of two or more feed signals, the set of feed signals including a first feed signal and a second feed signal with the first feed signal and the second feed signal corresponding respectively with a special sheet and an imagable regular substrate having opposing sides. The scheduling apparatus further includes a controller for generating the first and second feed signals. The controller, which communicates with each of a print engine and a special sheet insertion apparatus determines whether the imagable regular substrate is to imaged on both of the opposing sides and, when it is determined that the imagable regular substrate is to be imaged on both the opposing sides, the controller schedules the first and second feed signals to be transmitted respectively to the print engine and the special sheet insert apparatus during a single pitch.

16 Claims, 13 Drawing Sheets

APPARATUS AND METHOD FOR SCHEDULING AN IMAGABLE SUBSTRATE AND A SPECIAL SHEET TO BE FED IN THE SAME PITCH

The present invention relates generally to a technique for a printing system, with a print engine and a special sheet insertion apparatus, in which special sheets are added to a delivered output of imaged regular substrates and, more particularly, to an apparatus and method for scheduling a first feed signal and a second feed signal to be transmitted respectively to the special sheet insertion apparatus and the print engine during the same pitch when a preselected condition is met.

The primary output product of a typical printing machine is a printed substrate, such as a sheet of paper bearing printed information in a specified format. Quite often, customer requirements necessitate that this output product be configured in various specialized arrangements or print sets ranging from stacks of collated loose printed sheets to tabulated and bound booklets. Even when using state of the art document producing and finishing apparatus, it may be necessary to insert sheets into the document which are produced by means other than the document producing apparatus, or produced at a separate time from the majority of the sheets contained in the print set. For example, it is not uncommon to place specially colored sheets, chapter dividers, photographs or other special insert sheets into a print set to produce a final document. For example, it is common to use preprinted sheets which were produced by four-color offset press techniques as special insert sheets in a document containing mostly text printed on ordinary white paper. In another example, booklets produced from signatures, often use special cover sheets or center sheets containing, for example, coupons. It is generally not desirable to pass these sheets through the printer processing apparatus because the ink on the special insert sheets tends to be smudged by the paper-handling rollers, etc. of the document producing apparatus. In addition, these special insert sheets may be of a particular weight stock or may include protruding tabs which may cause jams when transported through the printer processor.

Accordingly, these special insert sheets must be inserted into the stream of sheets subsequent to processing in the printer processor section of the document producing apparatus. It is desirable to insert these sheets without disrupting the flow of the continuous stream of processed sheets. It is also desirable to insert these sheets in a manner which is transparent to the print processor on the finishing apparatus so that the operation of these apparatus need not be modified. The following disclosures relate to the area of inserting one or more insert sheets among a plurality of previously marked sheets:

U.S. Pat. No. 5,272,511
Patentees: Conrad et al.
Issued: Dec. 21, 1993
U.S. Pat. No. 4,961,092
Patentee: Rabbet al.
Issued: Oct. 2, 1990
U.S. Pat. No. 4,602,776
Patentee: York et al.
Issued: Jul. 29, 1986
U.S. Pat. No. 4,561,772
Patentee: Smith
Issued: Dec. 31, 1985

U.S. Pat. No. 4,536,078
Patentee: Ziehm
Issued: Aug. 20, 1985
U.S. Pat. No. 4,248,525
Patentee: Sterret
Issued: Feb. 3, 1981
Xerox Disclosure Journal—Vol. 19, No. 4, pp. 333–336
Patentee: John R. Yonovich
Disclosed: July/August 1994

U.S. Pat. No. 5,272,511 discloses a sheet inserter for inserting one or more special insert sheets into a continuous stream of sheets by overlaying the insert sheets with a corresponding sheet in the continuous stream of sheets. The insert sheet overlaying the corresponding sheet in the continuous stream of sheets is then conveyed with the corresponding sheet to a final destination where the sheets can be compiled into a stack.

U.S. Pat. No. 4,961,092 discloses a preprogrammed post-collation system for a copier which uses plural sorter bins and a recirculating document handler. Preprogrammable pause points in the copying operation allow for repeatedly inserting a variable number of job inserts or other special copy sheets into the bins being filled (by producing copies of these special documents or by manually inserting them into the bins), at any selected document copying point. The copying sequence must be manually restarted after the appropriate insertion operation is completed.

U.S. Pat. No. 4,602,776 discloses an insertion apparatus for use with a copier and/or a collator for providing on-line and off-line insertion of sheet material or collation, respectively. A supply tray is loaded with one or more types of insert material, each type being separated by a first type of coded sheet. A copying operation is interrupted when a second type of coded sheet, located in the stack to be copied and indicating a location where insert sheets are to be inserted, is detected. As the insert sheets are fed, a second sensor detects the first type of coded sheet (indicating the end of the group of insert sheets), which is then fed to an overflow tray. The normal copying operation is then resumed.

U.S. Pat. No. 4,536,078 discloses an automatic document handling system for recirculative document duplex copying to provide precollated simplex or duplex copies with proper image orientation on the output copy sheet for copies made on special orientation restricted copy sheets as well as non-orientation sensitive copy sheets. A switching system is provided for selecting between feeding of copy sheets from a main supply tray or a special copy sheet supply tray. A control system is provided for causing the document handling system to circulate the input copy sheets once before copying, to count the input copy sheets and to determine whether an odd or even number of input sheets are being provided to improve operating efficiency.

U.S. Pat. No. 4,561,772 to Smith discloses several approaches for inserting orientation sensitive paper into a copier with a paper path loop and two paper trays disposed adjacent the loop. With the Smith copier, orientation sensitive paper can be loaded into one of the trays for feeding into the loop in accordance with the marking requirements of a copy job. In one example, a system operator informs the controller of the copier of the presence of orientation sensitive paper by activating a switch or button. Accordingly, the copy job is processed, in part, on the basis of the switch being activated.

U.S. Pat. No. 4,248,525 discloses an apparatus for producing sets of collated copies wherein some of the sheets in a document (regular sheets) can be reproduced in a collating mode by means of a copier having a recirculating document handler (RDH), while other sheets in the document (insert sheets) cannot be produced in a collating mode by the RDH. Each sheet which cannot be imaged using the RDH is first individually copied multiple times and fed to a separate storage bin. These sheets later will be inserted into the stream of collated regular sheets as they are copied and output from the copier. A controller is preprogrammed with the page numbers of the sheets to be inserted. The regular sized sheets are then placed (in order) in the RDH, and multiple collated copies are made and fed toward a finisher (stapler). Copies of the regular sized sheets in the document are thus output from the copier in order (collated), with the insert sheets missing. Since the controller keeps track of the number of sheets being copied, the controller is able to temporarily stop the. RDH at the appropriate time and cause the appropriate insert sheet to be fed from its corresponding storage bin into the stream of regular sheets output from the copier. Thus, collated complete print sets of a particular document are generated.

The Xerox Disclosure Journal article discloses a dual function sheet feeder including first and second sheet feeding paths which share common initial document path portion, diverting at a gate to provide separate functions. The first sheet feeding path allows input documents to be transported for document imaging and onward to a document restacking tray. The second sheet feeding path allows transport of input documents into a print engine input path to be merged into the regular sheet feeding path for delivery to the finisher.

In various known printing systems, marking software is employed, in conjunction with one or more controllers, to implement a sheet scheduling technique. More particularly, in one known system each page of a job is programmed for printing and the corresponding marking related information is communicated to a print manager node. In turn, the print manager node generates a schedule indicating the sequence in which the sides of the job pages are to be printed. This is a straightforward process, provided each page is to be printed in simplex. If, however, selected ones of the pages are to be printed in duplex with a multipass approach, then the schedule must reflect the order in which the various sides of the pages are to be imaged. Pursuant to generating a schedule, the print manager node passes the schedule along to various other nodes, such as a marking node and a paper handling node, to coordinate operation of the printing system during the imaging process. When an inserter is used in conjunction with a print engine, the schedule generated by the print manager will, by necessity, include information regarding the times at which insertion sheets are to be fed into a stream of imaged sheets exiting the print engine. The following patents relate to the area of sheet scheduling:

U.S. Pat. No. 5,095,342

Patentees: Farrell et al.

Issued: Mar. 10, 1992

U.S. Pat. No. 5,184,185

Patentees: Rasmussen et al.

Issued: Feb. 2, 1993

U.S. Pat. No. 5,337,135

Patentees: Malachowski et al.

Issued: Aug. 9, 1994

U.S. Pat. No. 5,095,342 discloses a printing system with an endless duplex loop in which copy sheets to be imaged are inserted consecutively into the duplex loop without placing any skipped pitches therebetween regardless of set or job boundaries. Duplex side ones from subsequent sets or jobs are used to fill any gaps which exist in the duplex side one sheet stream of earlier sets or jobs.

U.S. Pat. No. 5,184,185 discloses a printing system wherein gaps, which naturally exist in the output of printed copy sheets from a duplex paper path due to duplex printing, are selectively combined with interset interval skipped pitches so as to provide an appropriate interset interval between each set of printed copy sheets output from a printer, while minimizing the number of skipped pitches which actually need to be scheduled.

U.S. Pat. No. 5,337,135 discloses a trayless duplex printer with a variable path velocity. The printer includes a paper path loop with plural drives driven by a variable speed drive. Through use of the variable speed drive, interleaving spaces can be generated between duplexing path sheets. Conversely, the variable speed drive can be operated so as to close up interleaving spaces.

All references cited in the present specification and their references are incorporated herein by reference where appropriate for appropriate teachings of additional or alternative details, features and/or technical background.

The above-cited U.S. Pat. No. 5,272,511 is advantageous in that the print engine need not skip a pitch in order to accommodate the insertion of a cover into a stream of imaged substrates. In particular, since a cover can be superposed on an imaged substrate, there is no need schedule for a "gap" at the photoreceptor. While the technique of the U.S. Pat. No. '511 is well suited for its intended purpose, namely to insert covers, it is not necessarily well suited for all situations in which one or more special sheets are to be inserted into the stream of image substrates. For example, a cover and imaged substrate are formed into a "sandwich" and moved along a paper path. If the paper path is too long, the cover and the imaged substrate can move away from one another, thus resulting in unsuitable compiling at an ultimate finishing destination. Accordingly, it is desirable, in the technique of the U.S. Pat. No. '511 to maintain a relatively short paper path. Maintaining a relatively short paper path in an insertion module, however, limits the ability of the module to accommodate one or more paper trays. Indeed, the module of the U.S. Pat. No. '511 does not actually contain a paper tray. Moreover, the technique of the U.S. Pat. No. '511 patent only accommodates for the insertion of one sheet at a time in the stream of imaged substrates. It would be desirable to provide an insertion apparatus which accommodates at least one or more paper trays and permits multiple substrates to be inserted into a paper path, at one time, without skipping any pitches.

In one aspect of the present invention there is provided a scheduling apparatus for a printing system, the printing system including a print engine for imaging regular substrates, fed to the print engine from a regular substrate feeding apparatus, and delivering the imaged regular substrates as output, the print engine being operatively coupled with a special sheet insertion apparatus, a special sheet insertion path passing by the special sheet insertion apparatus, the special sheet insertion apparatus including one or more special sheets being feedable to the substrate insertion path and addable to the delivered output of imaged regular substrates. The scheduling apparatus includes: a) a memory for storing a set of two or more feed signals, the set of feed signals including a first feed signal and a second feed signal with the first feed signal and the second feed signal corresponding respectively with a special sheet and an imagable regular substrate having opposing sides; b) a controller for generating the first and second feed signals; c) said controller communicating with each of the print engine and the special sheet insertion apparatus, each of the special sheet insertion apparatus and the print engine being respectively responsive to the first feed signal and the second feed signal; d) said controller determining whether the imagable regular substrate is to be imaged on both of the opposing sides; and e) said controller scheduling the first and second feed signals to be transmitted respectively to the print engine and the special sheet insert apparatus during a single pitch, for feeding the imagable regular substrate and the special sheet during the single pitch, when it is determined that the imagable regular substrate is to be imaged on both the opposing sides.

In another aspect of the present invention, there is provided a method of scheduling a print job in a printing system, the printing system including a print engine for imaging regular substrates, fed to the print engine from a regular substrate feeding apparatus, and delivering the imaged regular substrates as output, the print engine being operatively coupled with a special sheet insertion apparatus, a special sheet insertion path passing by the special sheet insertion apparatus, the special sheet insertion apparatus including one or more special sheets being feedable to the substrate insertion path and addable to the delivered output of imaged regular substrates, comprising: a) generating a set of two or more feed signals, the set of feed signals including a first type of feed signals and a second type of feed signals with the first type of feed signal and the second type of feed signal corresponding respectively with a set of special sheets and a set of imagable regular substrates, each of the imagable regular substrates having opposing sides; b) referencing a first pointer to a first one of the feed signals and a second pointer to a second one of the feed signals; c) determining whether the feed signal referenced by the first pointer is a first feed signal type and whether the feed signal referenced by the second pointer is a second feed signal type; and d) scheduling the feed signal referenced by the first pointer and the feed signal referenced by the second pointer to be transmitted respectively to the special sheet insert apparatus and the print engine during a single pitch, for feeding one of the imagable regular substrates and one of the special sheets during the single pitch, when it is determined, with said c), that the feed signal referenced by the first pointer is a first feed signal type and the feed signal referenced by the second pointer is a second feed signal type.

These and other aspects of the invention will become apparent from the following description, the description being used to illustrate a preferred embodiment of the invention when read in conjunction with the accompanying drawings.

Figure 1:
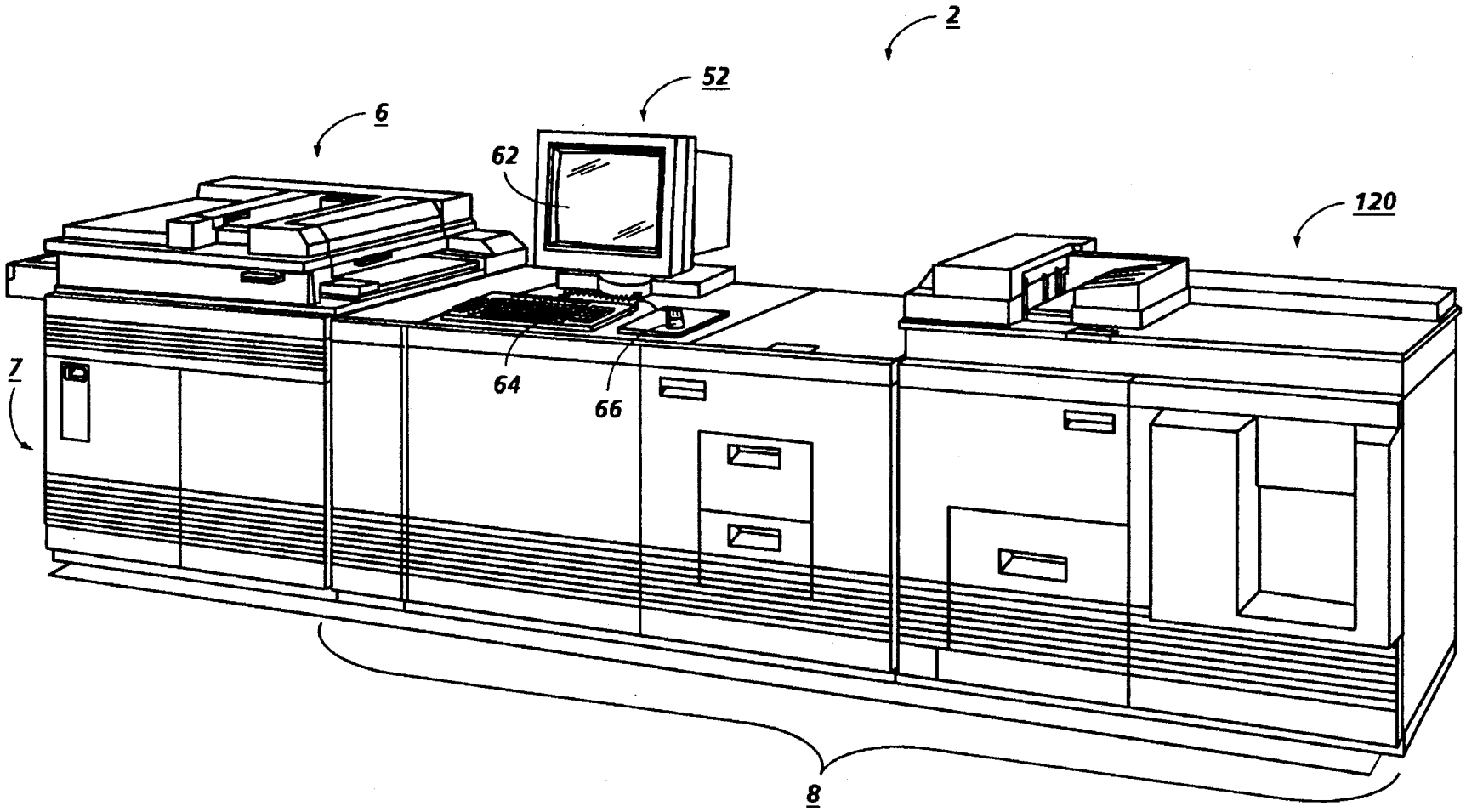
FIG. 1 is a perspective view depicting an electronic printing system.
Figure 3:
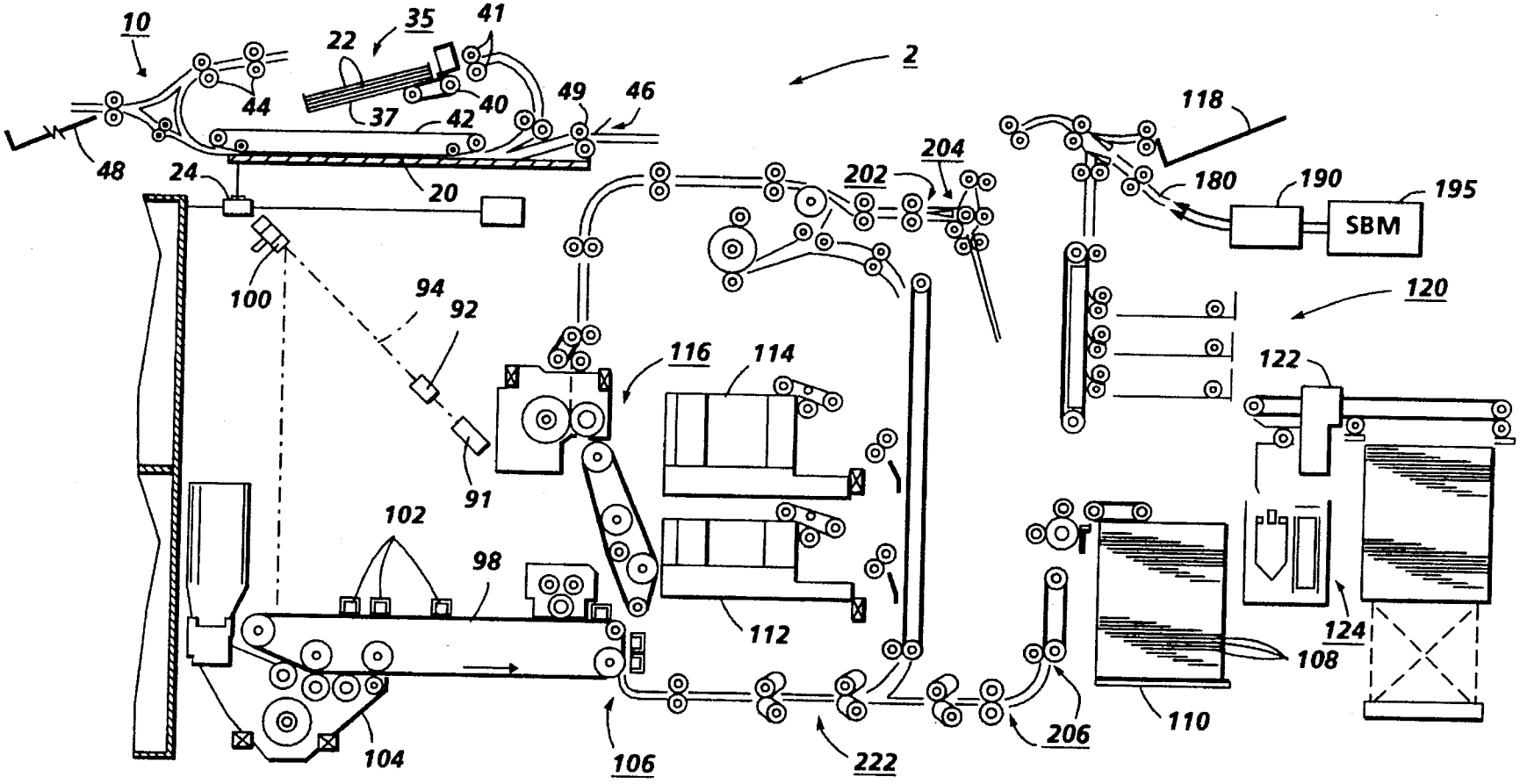
FIG. 3 is an elevational view illustrating the principal mechanical components of the printing system shown in FIG. 1.
Figure 5:
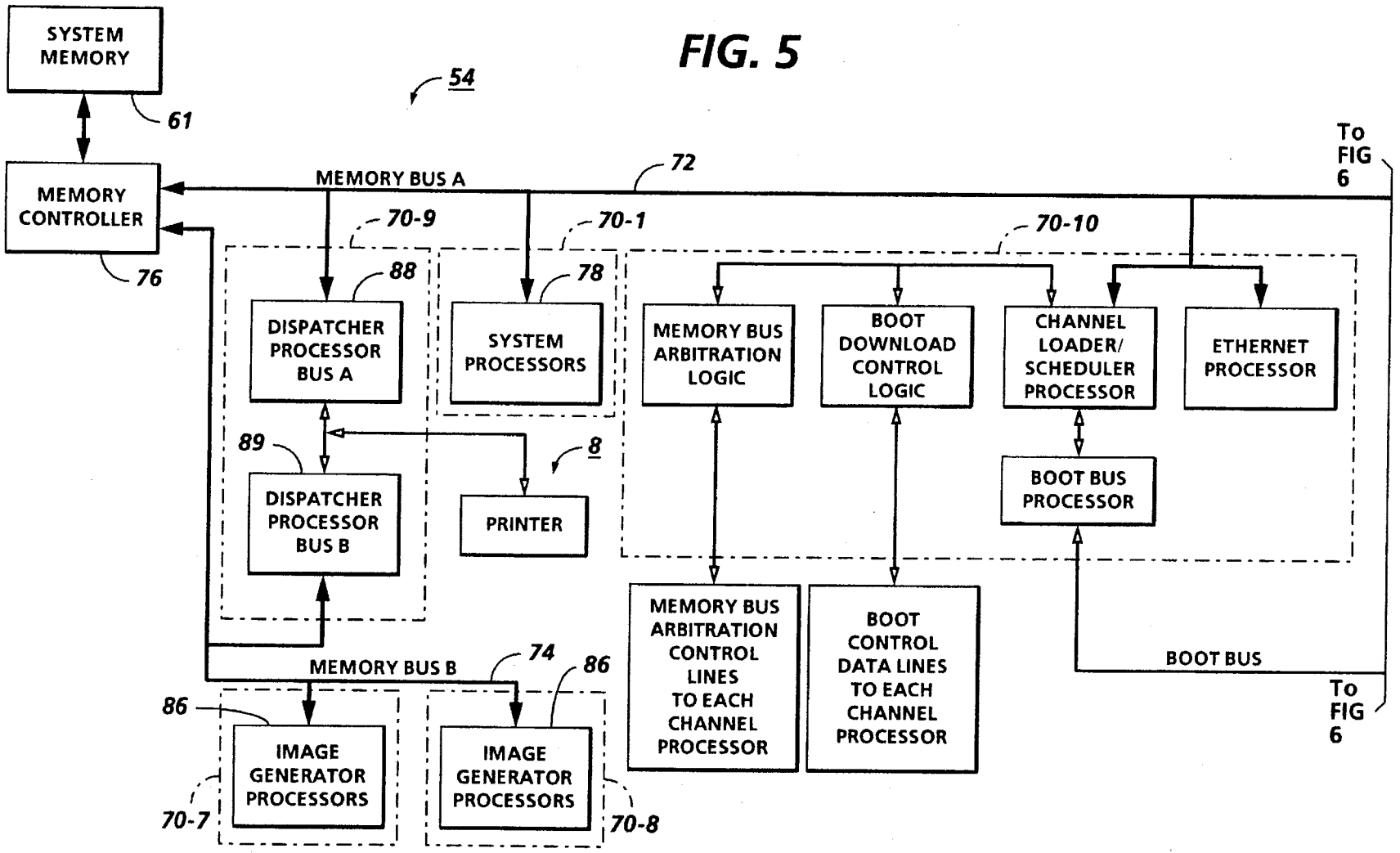
Figure 6:
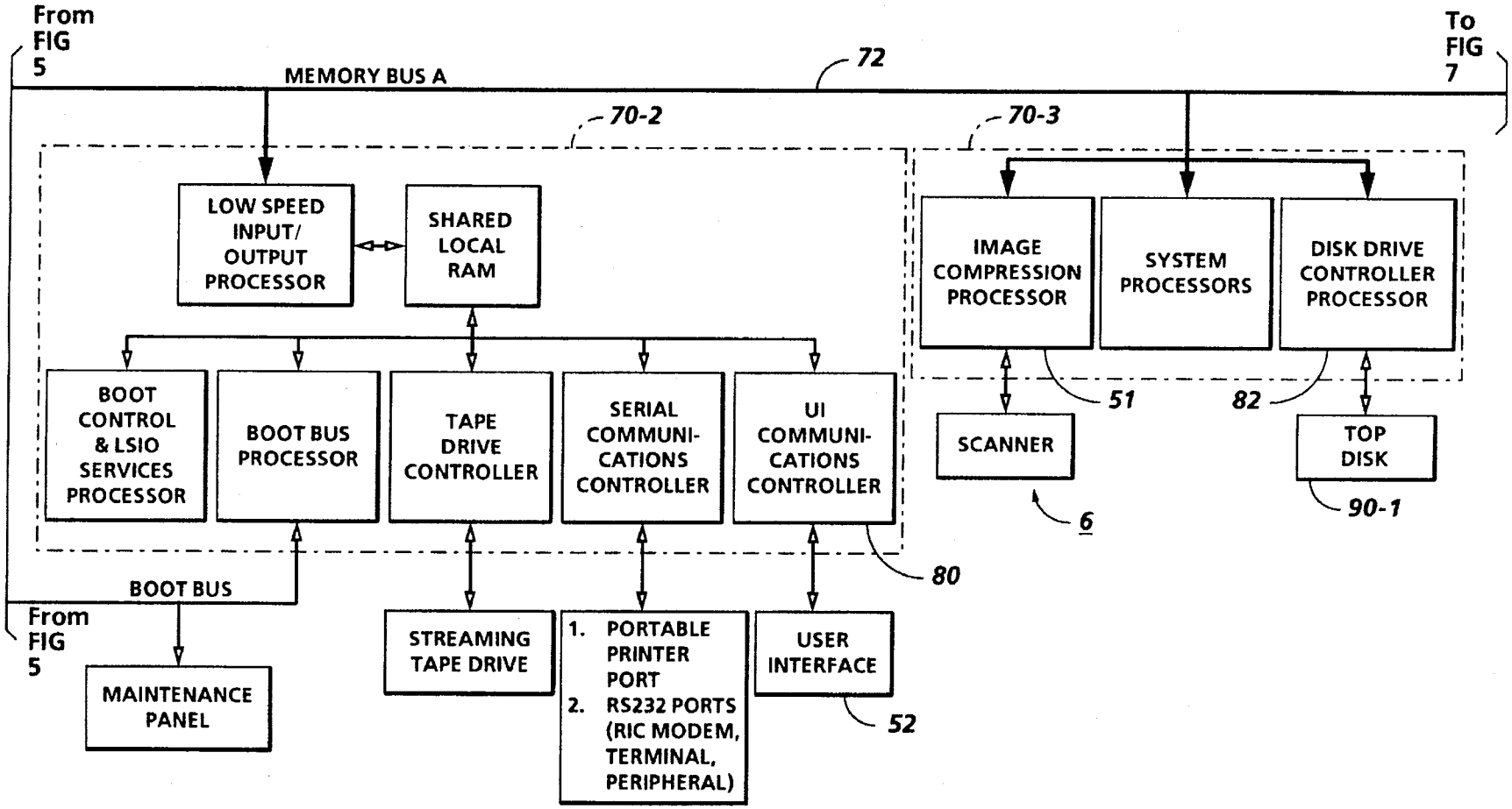
Figure 7:
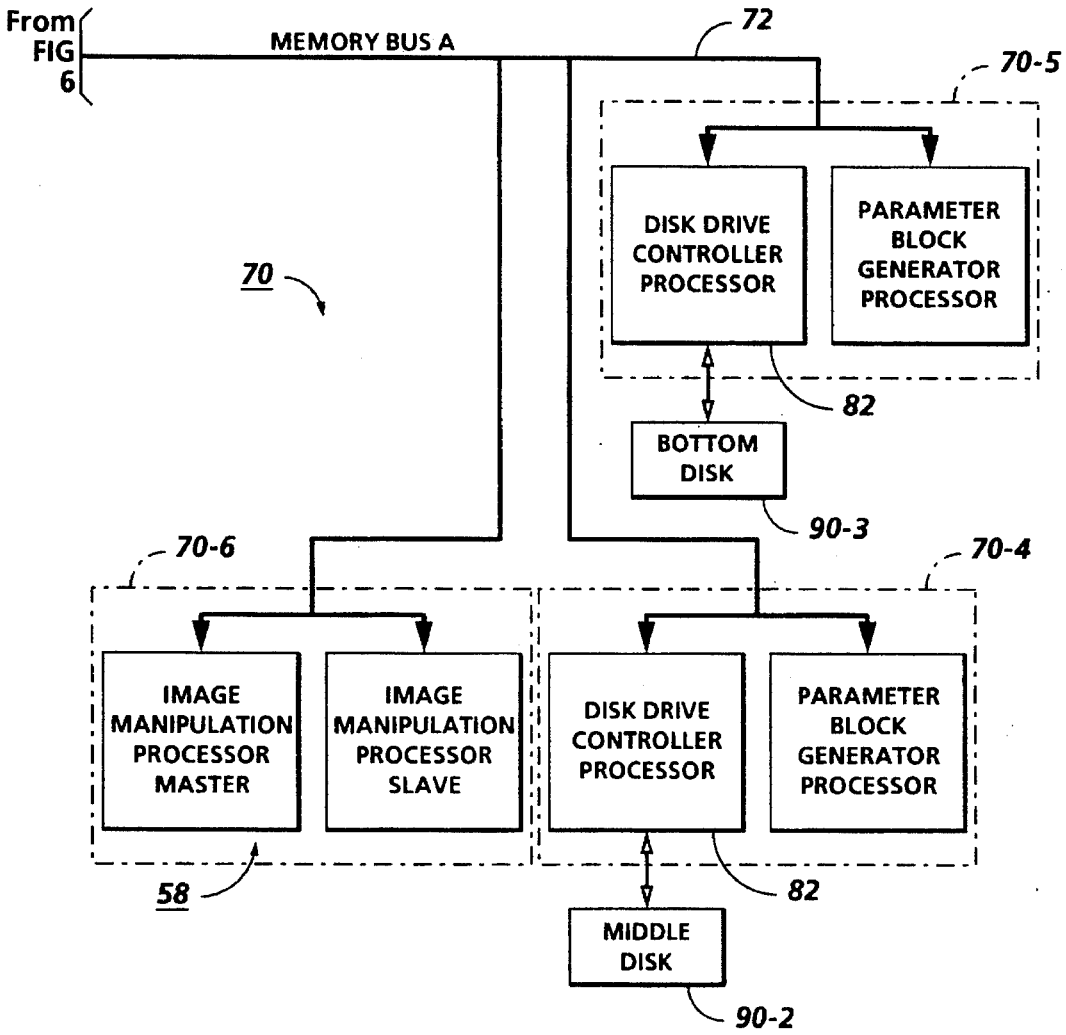
Figure 8:
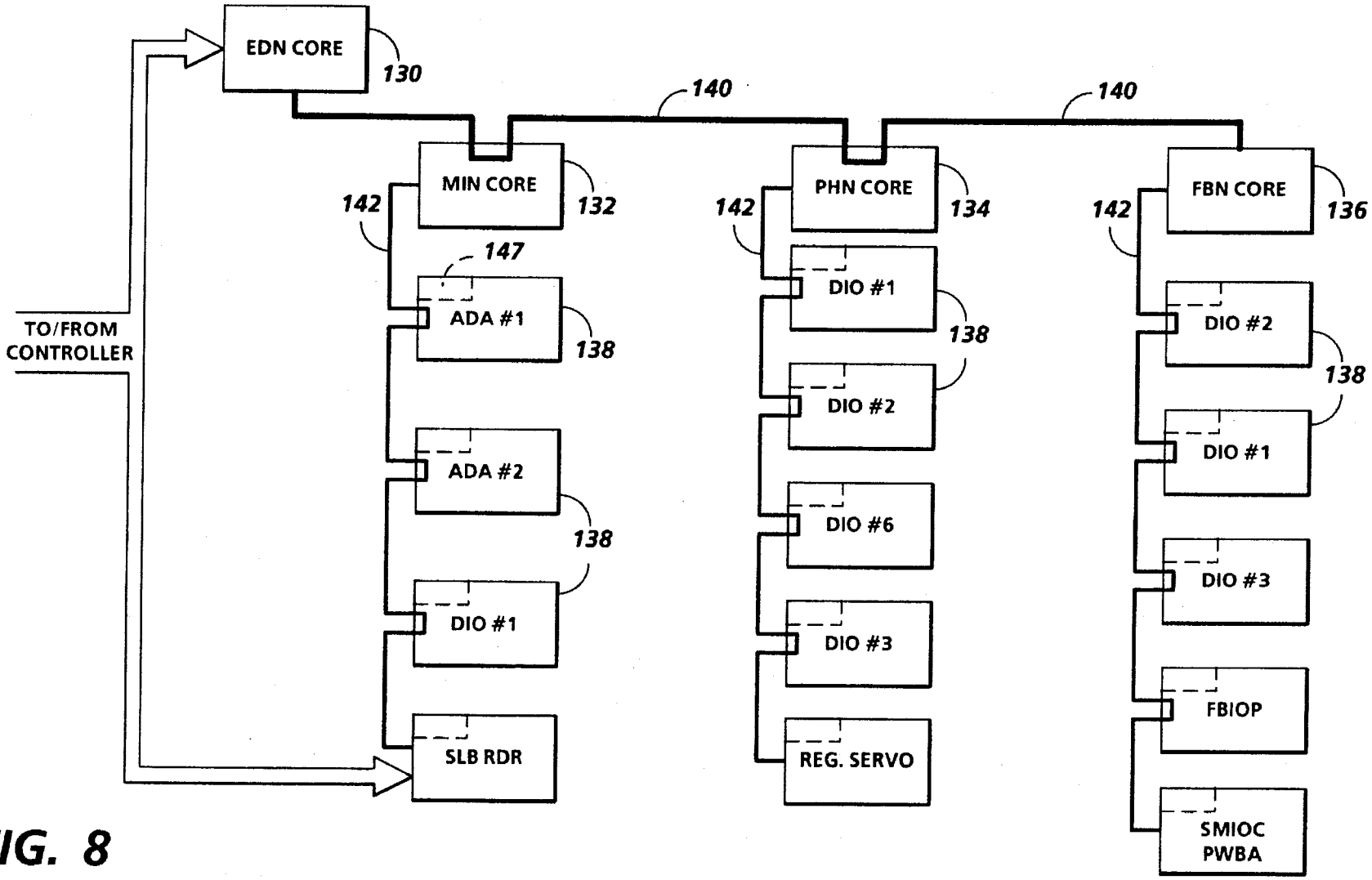
Figure 9:
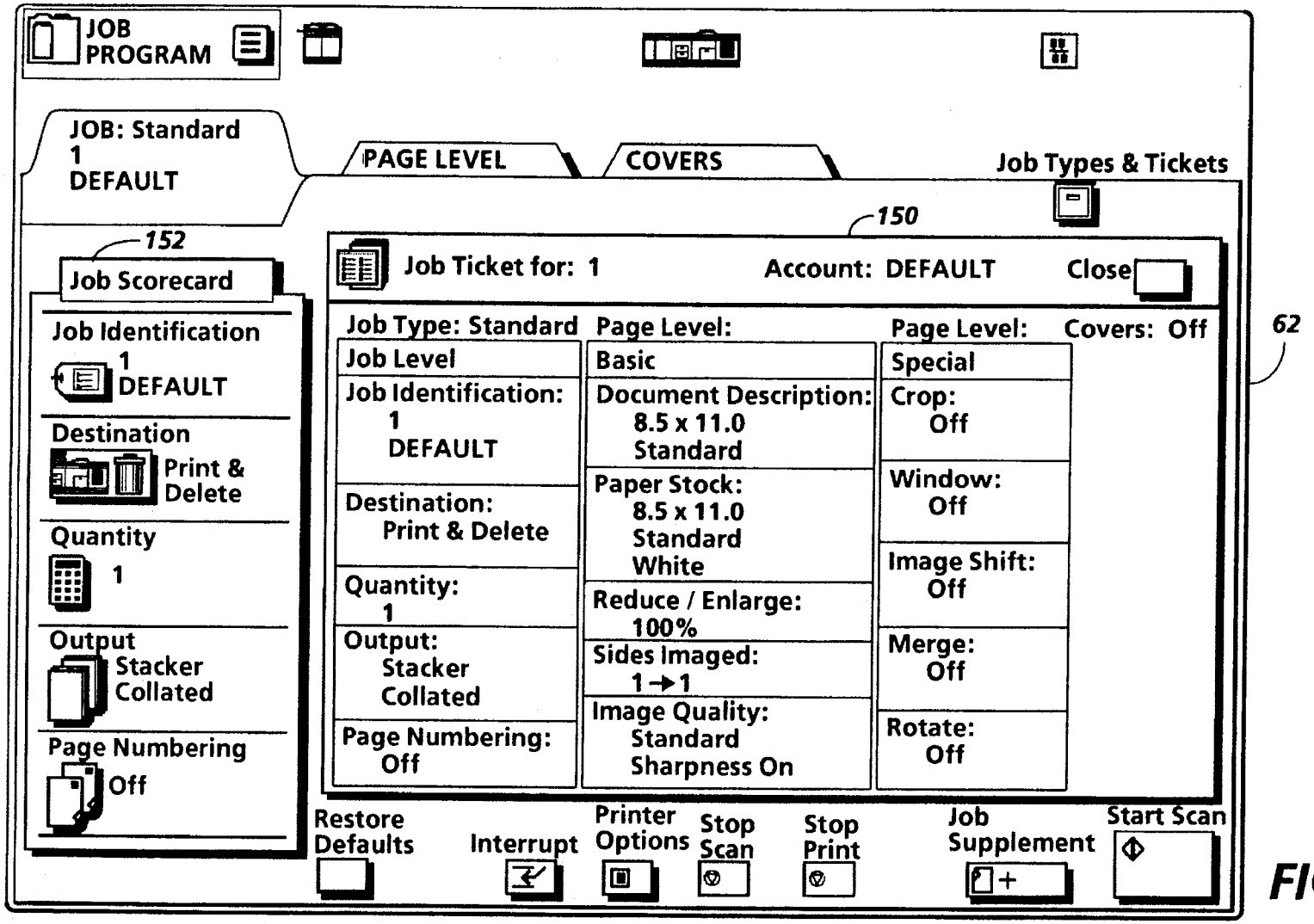
Figure 10:
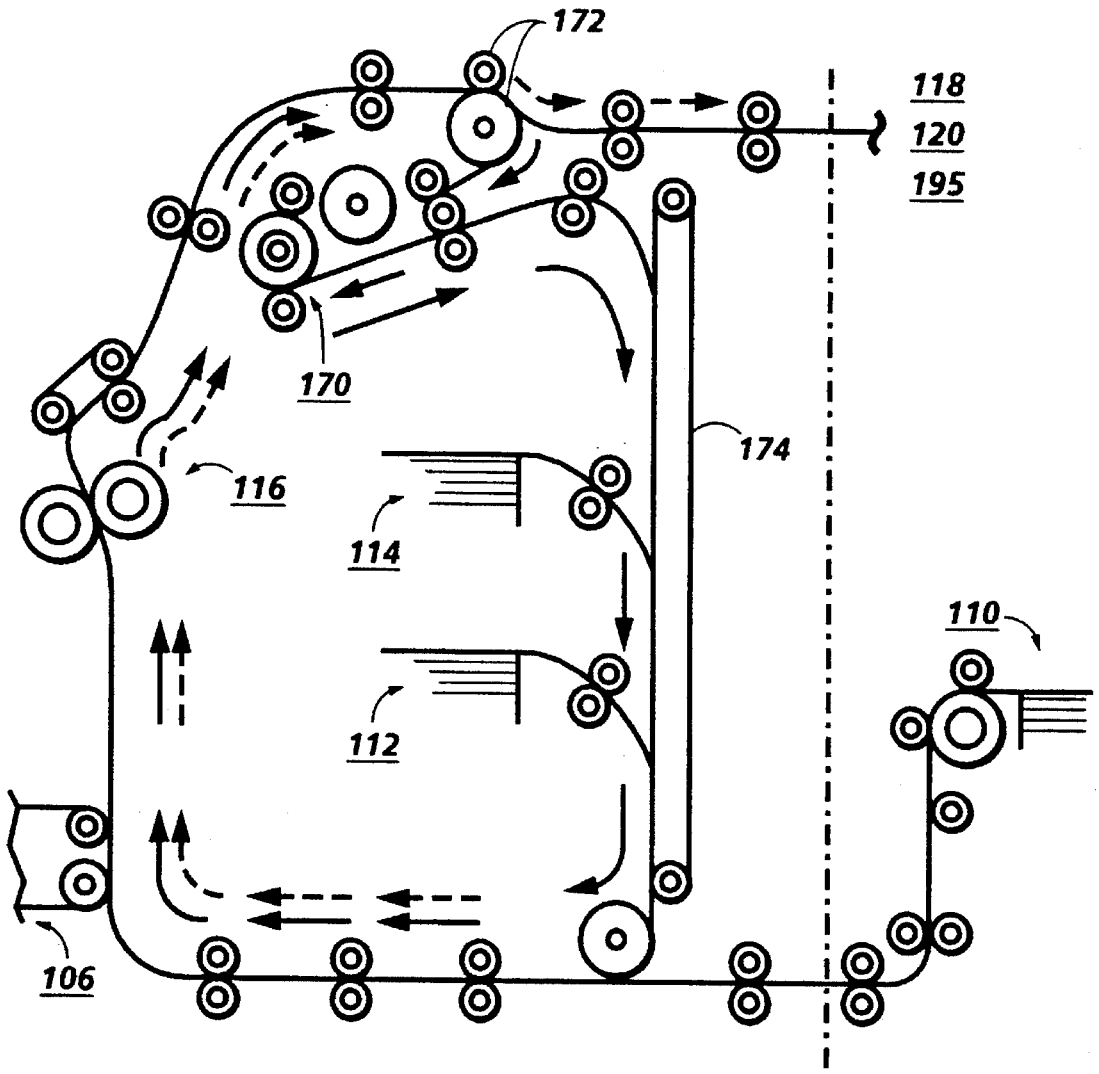
Figure 11:
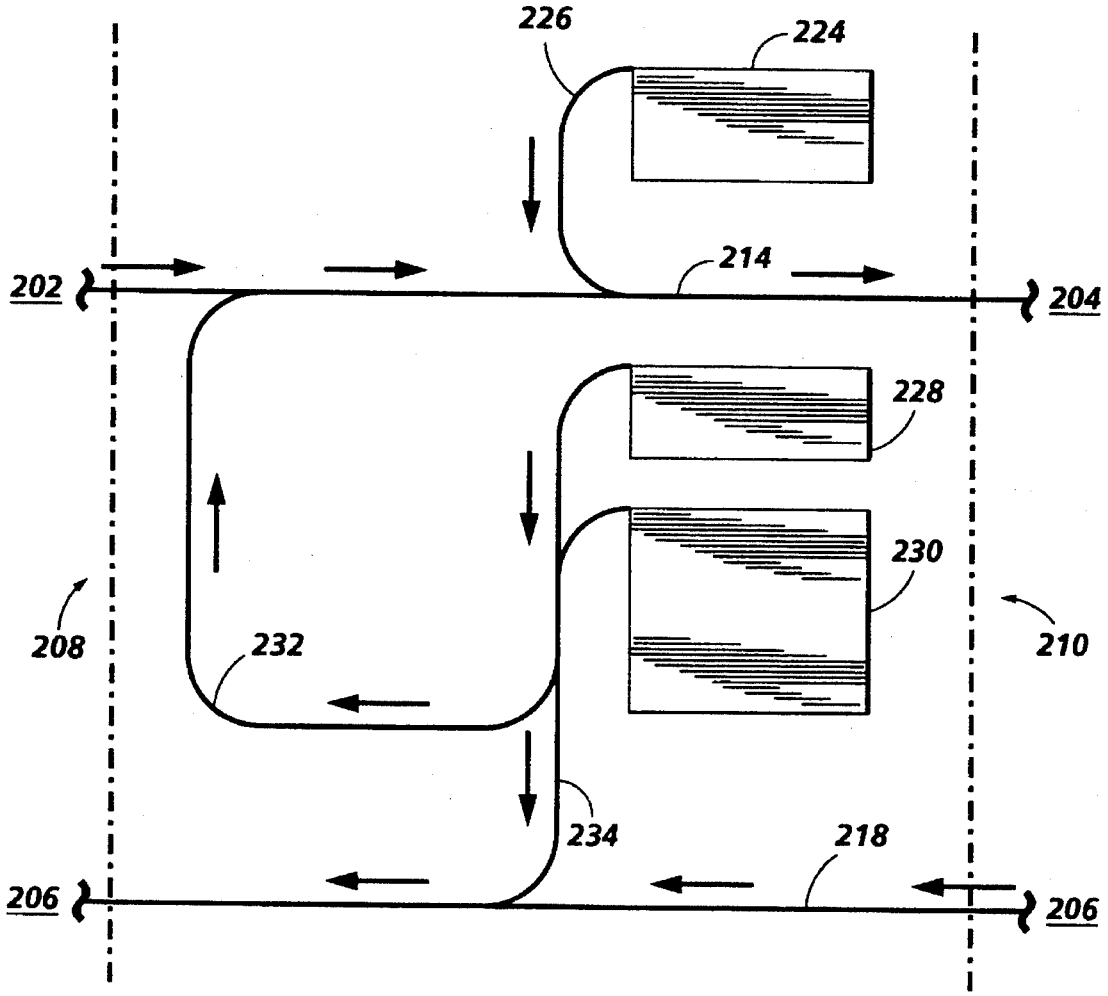
Figure 12:
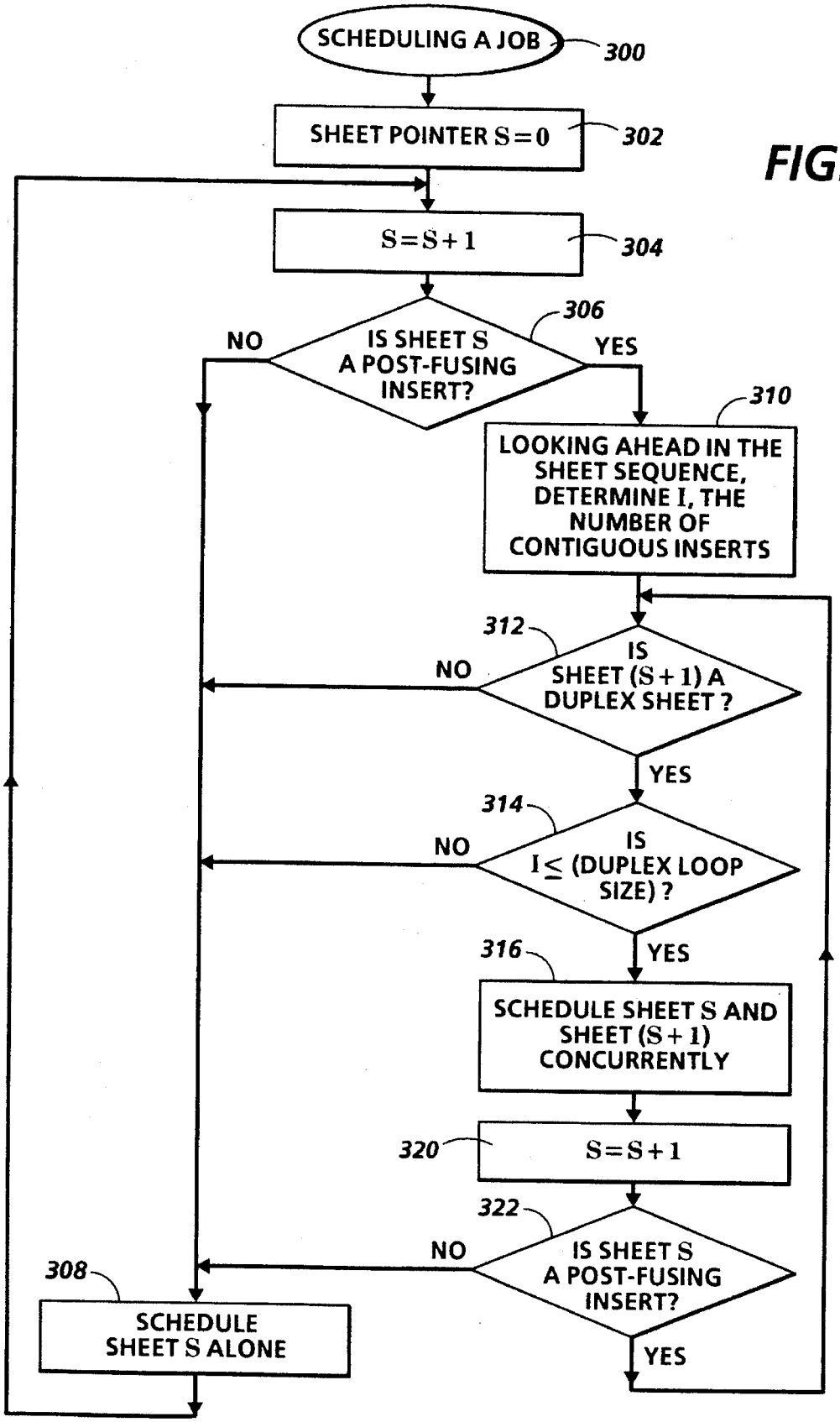
Figure 13:
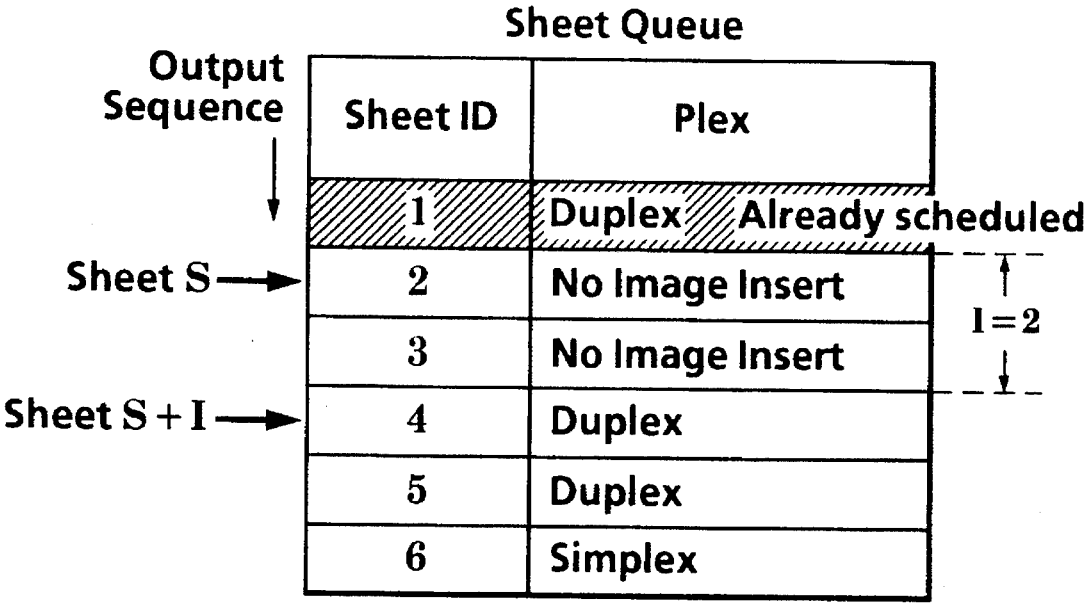

FIGS. 5–7 comprise a schematic block diagram showing the major parts of a control section of the printing system shown in FIG. 1;

FIG. 8 is a block diagram of the Operating System, together with Printed Wiring Boards and shared line connections for the printing system shown in FIG. 1;

FIG. 9 is an elevational view depicting an exemplary job programming ticket and job scorecard displayed on the User Interface(UI) touchscreen of the printing system shown in FIG. 1;

FIG. 10 is an elevational view illustrating simplex and duplex paper paths through which sheets are conveyed through the system of FIG. 3;

FIG. 11 is an elevational view schematically illustrating various mechanical components of an interposing module, the interposing module being operatively coupled with the printing system of FIG. 1;

FIG. 12 is a flow diagram depicting a technique for scheduling feed signals corresponding respectively with the various substrates/sheets to be used in producing one or more jobs; and FIG. 13 is a schematic view of a sheet queue in which a plurality of sheet identifiers are mapped respectively with plex types.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 2:
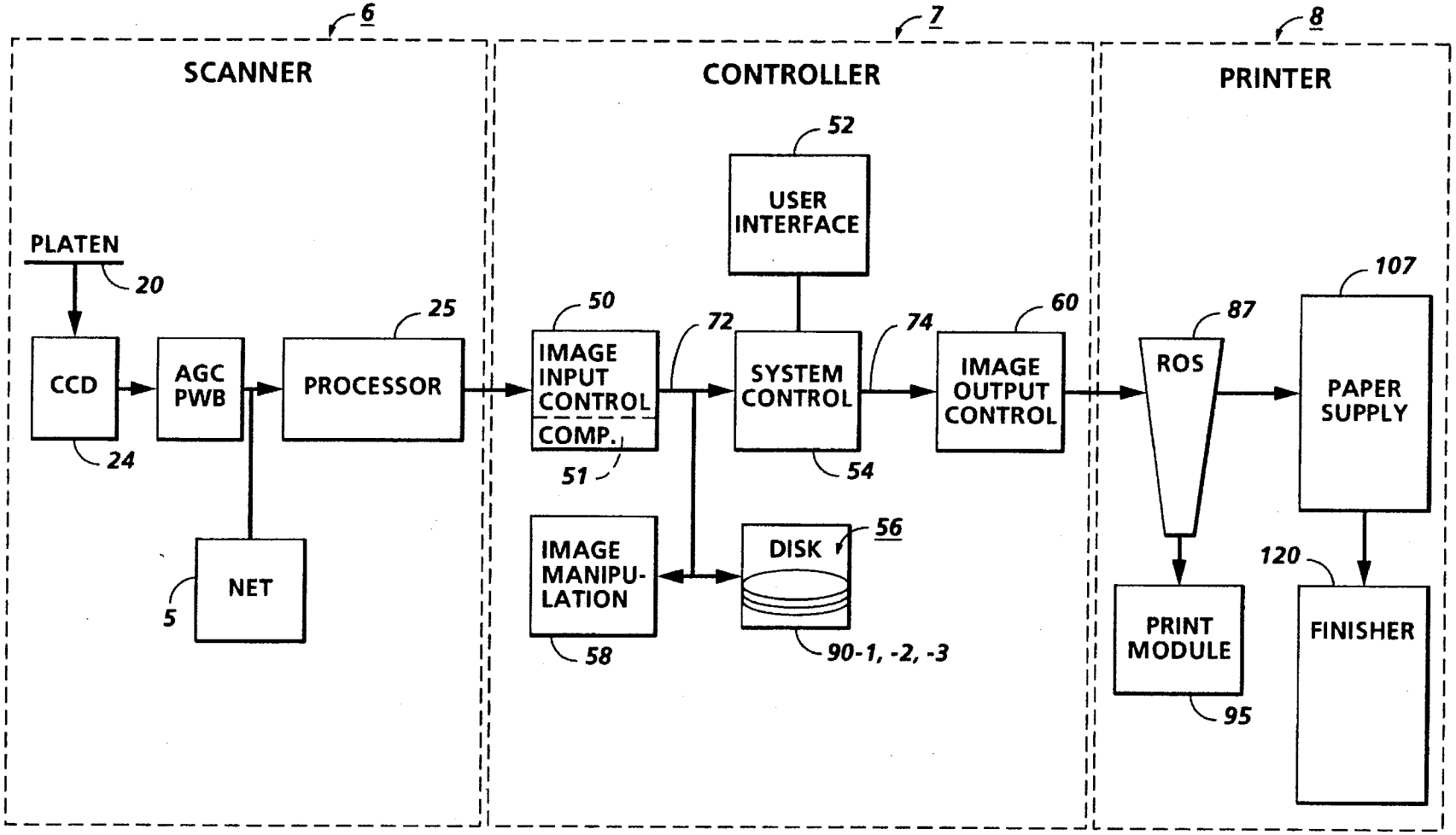
FIG. 2 is a block diagram depicting the major elements of the printing system shown in FIG. 1.

Referring to FIGS. 1 and 2, there is shown an exemplary laser based printing system (or imaging device) 2 for processing print jobs in accordance with the teachings of the present invention. Printing system 2, for purposes of explanation, is divided into a scanner section 6, controller section 7, and printer section 8. While a specific printing system is shown and described, the present invention may be used with other types of printing systems such as ink jet, ionographic, etc.

For off-site image input, image input section 4 has a network 5 with a suitable communication channel, such as an ethernet connection, enabling image data, in the form of image signals or pixels, from one or more remote sources, to be input to system 2 for processing. Other remote sources of image data, such as streaming tape, floppy disk, video camera, etc. may be envisioned.

Figure 4:
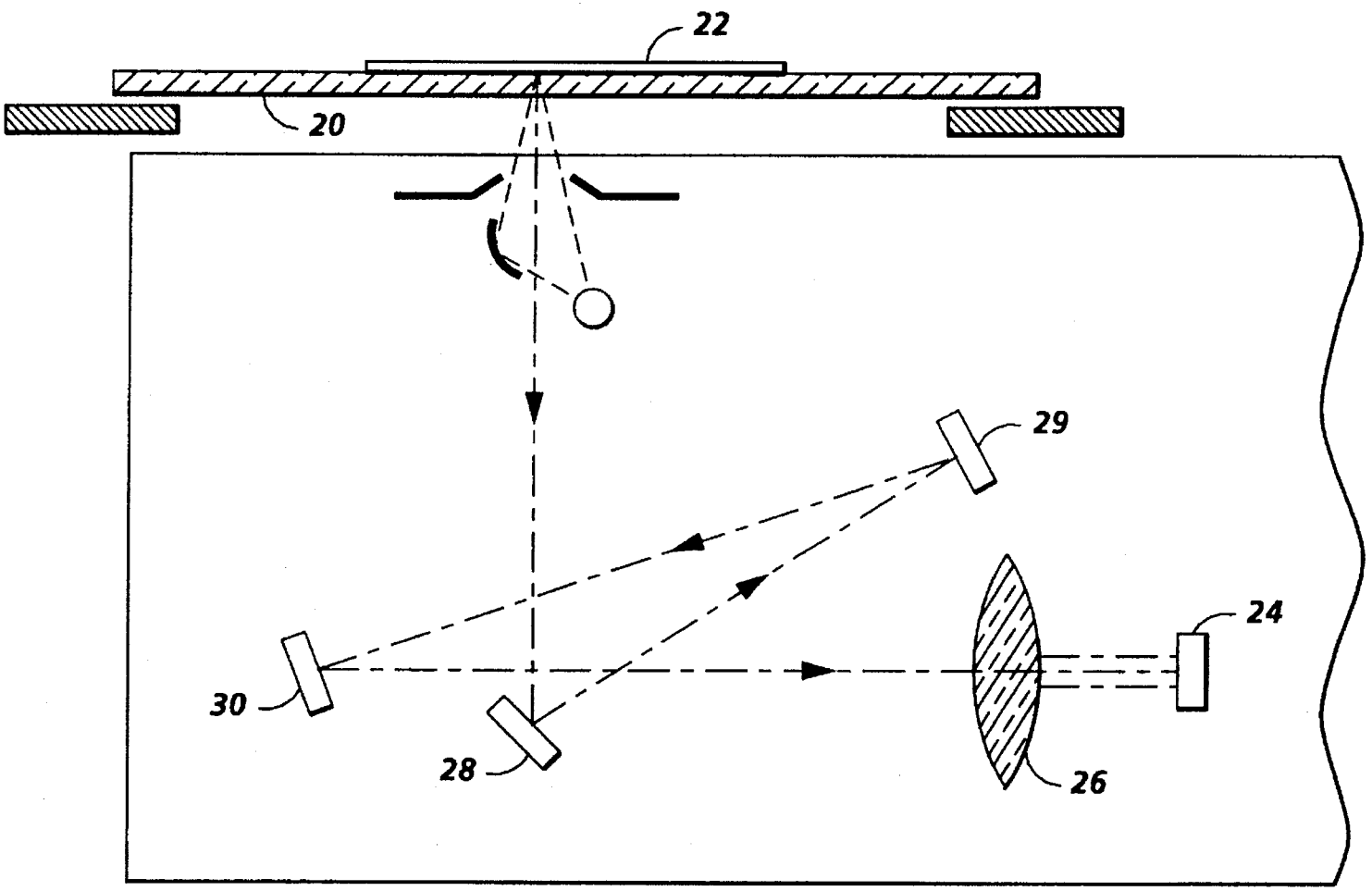
FIG. 4 is a schematic view showing certain construction details of a document scanner of the printing system shown in FIG. 1.

Referring particularly to FIGS. 2–4, scanner section 6 incorporates a transparent platen 20 on which the document 22 to be scanned is located. One or more linear arrays 24 are supported for reciprocating scanning movement below platen 20. Lens 26 and mirrors 28, 29, 30 cooperate to focus array 24 on a line like segment of platen 20 and the document being scanned thereon. Array 24 provides image signals or pixels representative of the image scanned which, after suitable processing by processor 25, are output to controller section 7.

Processor 25 converts the analog image signals output by array 24 to digital image signals and processes the image signals as required to enable system 2 to store and handle the image data in the form required to carry out the job programmed. Processor 25 also provides enhancements and changes to the image signals such as filtering, thresholding, screening, cropping, reduction/enlarging, etc. Following any changes and adjustments in the job program, the document must be rescanned.

Documents 22 to be scanned may be located on platen 20 for scanning by automatic document handler (ADF) 35 operable in either a Recirculating Document Handling (RDH) mode or a Semi-Automatic Document Handling (SADH) mode. A manual mode including a Book mode and a Computer Forms Feeder (CFF) mode are also provided, the latter to accommodate documents in the form of computer fanfold. For RDH mode operation, document handler 35 has a document tray 37 in which documents 22 are arranged in stacks or batches. The documents 22 in tray 37 are advanced by vacuum feed belt 40 and feed rolls 41 onto platen 20 where the document is scanned by array 24. Following scanning, the document is removed from platen 20 and discharged into catch tray 48.

For operation in the CFF mode, computer forms material is fed through slot 46 and advanced by feed rolls 49 to document feed belt 42 which in turn advances a page of the fanfold material into position on platen 20.

Referring to FIGS. 2 and 3, printer section 8 comprises a laser type printer and, for purposes of explanation, is separated into a Raster Output Scanner (ROS) section 87, Print Module Section 95, Paper Supply Section 107, and High Speed Finisher 120. ROS 87 has a laser 91, the beam of which is split into two imaging beams 94. Each beam 94 is modulated in accordance with the content of an image signal input by acousto-optic modulator 92 to provide dual imaging beams 94. Beams 94 are scanned across a moving photoreceptor 98 of Print Module 95 by the mirrored facets of a rotating polygon 100 to expose two image lines on photoreceptor 98 with each scan and create the latent electrostatic images represented by the image signal input to modulator 92. Photoreceptor 98 is uniformly charged by corotrons 102 at a charging station preparatory to exposure by imaging beams 94. The latent electrostatic images are developed by developer 104 and transferred at transfer station 106 to a print media 108 delivered by Paper Supply section 107. Media 108, as will appear, may comprise any of a variety of sheet sizes, types, and colors. For transfer, the print media is brought forward in timed registration with the developed image on photoreceptor 98 from either a main paper tray 110 or from auxiliary paper trays 112, or 114. The developed image transferred to the print media 108 is permanently fixed or fused by fuser 116 and the resulting prints discharged to either output tray 118, to high speed finisher 120, or through bypass 180 to some other downstream finishing device, which could be a low speed finishing device such as a signature booklet maker (SBM) 195 of the type manufactured by Bourg AB. High speed finisher 120 includes a stitcher 122 for stitching or stapling the prints together to form books and thermal binder 124 for adhesively binding the prints into books.

Referring still to FIG. 3, the SBM 195 is coupled with the printing system 2, by way of a bypass 180, for receiving printed signatures. A sheet rotary 190 is positioned at an input of the SBM and the SBM includes three stations, namely a stitching station, a folding station and a trimming station, in which a plurality of signatures are processed. In operation, the signatures are transported through the bypass 180 to the sheet rotary 190 where the signatures are rotated, if necessary. The signatures are then introduced to the stitching station where the signatures are assembled as a stitched booklet. The stitched booklet is delivered to the folding station where it is preferably folded in half with a folding bar. At the trimming station, uneven edges of the folded signature set are trimmed with a cutting blade. Further details regarding the structure and function of the SBM 195 can be obtained by reference to U.S. Pat. No. 5,159,395 to Farrell et al.

Referring to FIGS. 1, 2 and 5, controller section 7 is, for explanation purposes, divided into an image input controller 50, User Interface(UI) 52, system controller 54, main memory 56, image manipulation section 58, and image output controller 60.

The scanned image data input from processor 25 of scanner section 6 to controller section 7 is compressed by image compressor/processor 51 of image output input controller 50 on PWB 70-3. As the image data passes through compressor/processor 51, it is segmented into slices N scanlines wide, each slice having a slice pointer. The compressed image data together with slice pointers and any related image descriptors providing image specific information (such as height and width of the document in pixels, the compression method used, pointers to the compressed-image data, and pointers to the image slice pointers) are placed in an image file. The image files, which represent different print jobs, are temporarily stored in system memory 61 which comprises a Random Access Memory or RAM pending transfer to main memory 56 where the data is held pending use.

As best seen in FIG. 1, UI 52 includes a combined operator controller/CRT display consisting of an interactive touchscreen 62, keyboard 64, and mouse 66. UI 52 interfaces the operator with printing system 2, enabling the operator to program print jobs and other instructions, to obtain system operating information, instructions, programming information, diagnostic information, etc. Items displayed on touchscreen 62 such as files and icons are actuated by either touching the displayed item on screen 62 with a finger or by using mouse 66 to point a cursor to the item selected and keying the mouse.

Main memory 56 has plural hard disks 90-1, 90-2, 90-3 for storing machine Operating System software, machine operating data, and the scanned image data currently being processed.

When the compressed image data in main memory 56 requires further processing, or is required for display on touchscreen 62 of UI 52, or is required by printer section 8, the data is accessed in main memory 56. Where further processing other than that provided by processor 25 is required, the data is transferred to image manipulation section 58 on PWB 70-6 where the additional processing steps such as collation, make ready, decomposition, etc. are carried out. Following processing, the data may be returned to main memory 56, sent to UI 52 for display on touchscreen 62, or sent to image output controller 60.

Image data output to image output controller 60 is decompressed and readied for printing by image generating processors 86 of PWBs 70-7, 70-8 (seen in FIG. 5). Following this, the data is output by dispatch processors 88, 89 on PWB 70-9 to printer section 8. Image data sent to printer section 8 for printing is normally purged from memory 56 to make room for new image data.

Referring particularly to FIGS. 5-7, control section 7 includes a plurality of Printed Wiring Boards (PWBs) 70, PWBs 70 being coupled with one another and with System Memory 61 by a pair of memory buses 72, 74. Memory controller 76 couples System Memory 61 with buses 72, 74. PWBs include system processor PWB 70-1 having plural system processors 78; low speed I/O processor PWB 70-2 having UI communication controller 80 for transmitting data to and from UI 52; PWBs 70-3, 70-4, 70-5 having disk drive controller/processors 82 for transmitting data to and from disks 90-1, 90-2, 90-3 respectively of main memory 56 (image compressor/processor 51 for compressing the image data is on PWB 70-3); image manipulation PWB 70-6 with image manipulation processors of image manipulation section 58; image generation processor PWBs 70-7, 70-8 with image generation processors 86 for processing the image data for printing by printing section 8; dispatch processor PWB 70-9 having dispatch processors 88, 89 for controlling transmission of data to and from printer section 8; and boot control-arbitration-scheduler PWB 70-10.

Referring particularly to FIG. 8, system control signals are distributed via a plurality of printed wiring boards (PWBs). These include EDN (electronic data node) core PWB 130, Marking Imaging core PWB 132, Paper Handling core PWB 134, and Finisher Binder core PWB 136 together with various Input/Output (I/O) PWBs 138. A system bus 140 couples the core PWBs 130, 132, 134, 136 with each other, while local buses 142 serve to couple the I/O PWBs 138 with each other and with their associated core PWB. Additionally, as seen in FIG. 8, the controller section 7 communicates with each of the PWBs.

A Stepper Motor Input Output Controller (SMIOC) Printed Wiring Board Assembly (PWBA) is included when the printing system is used with an SBM. The SMIOC PWBA controls the operation of a sheet rotator which may be required when using the SBM. The SMIOC PWBA also handles the exporting of control signals from the printer to the SBM and monitors the status lines from the SBM. The SBM has two status lines whose status is either high or low. The status lines respectively indicate whether the SBM is ready and whether the SBM (output stacking tray) is full.

On machine power up, the Operating System software is loaded from memory 56 to EDN core PWB 130 and from there to remaining core PWBs 132, 134, 136 via bus 140, each core PWB 130, 132, 134, 136 having a boot ROM 147 for controlling downloading of Operating System software to PWB, fault detection, etc. Boot ROMs 147 also enable transmission of Operating System software and control data to and from PWBs 130, 132, 134, 136 via bus 140 and control data to and from I/O PWBs 138 via local buses 142. Additional ROM, RAM, and NVM memory types are resident at various locations within system 2.

Referring to FIG. 9, jobs are programmed in a Job Program mode in which there is displayed on touch-screen 62 a Job Ticket 150 and a Job Scorecard 152 for the job being programmed. Job Ticket 150 displays various job selections programmed while Job Scorecard 152 displays the basic instructions to the system for printing the job.

In one embodiment, the printing system 2 is a DocuTech® Network Printing System ("Network Printer") which prints jobs transmitted from a workstation(not shown) by way of the network connection 5 (FIG. 2). The Network Printer processes network jobs written in a page description language ("PDL") known as "Interpress" and as a prerequisite to printing the network job, the Network Printer decomposes the job from a high level primitive form to a lower level primitive form. The decomposition process is discussed in further detail in U.S. application Ser. No. 07/898,761 entitled "Apparatus and Method for Multi-Stage/Multi-Process Decomposing", filed on Jun. 12, 1992, by Bonk et al., the pertinent portions of which are incorporated herein by reference. In another embodiment, the Network Printer is used, in conjunction with a DocuTech® Network Server, to print jobs written in, among other PDLs, Postscript®. The structure and operation of the DocuTech® Network Server may be more fully comprehended by reference to U.S. Pat. No. 5,226,112 to Mensing et al., the pertinent portions of which are incorporated herein by reference. Decomposed jobs are commonly stored, for output, in a job file (not shown) of the Network Printer and later transferred to a print queue for printing. As discussed in further detail below there can be delays associated with printing network jobs.

FIG. 10 is a plan view illustrating the duplex and simplex paper paths through which sheets are conveyed in the system of FIG. 3. In FIG. 10, the path through which a sheet travels during duplex imaging is illustrated by the arrowed solid lines, whereas the path through which a sheet to be simplex imaged travels is illustrated by the arrowed broken lines. After an appropriately sized sheet is supplied from one of feed trays 110, 112 or 114, the sheet is conveyed past image transfer station 106 to receive an image. The sheet then passes through fuser 116 where the image is permanently fixed or fused to the sheet. After passing through rollers 172, gates (not shown) either allow the sheet to move directly to a final destination (e.g., tray 118, high speed finisher 120, SBM 195), or deflects the sheet into single sheet inverter 170. If the sheet is either a simplex sheet or a duplex sheet having completed side one and side two images formed thereon, the sheet will be conveyed directly to its final destination. If the sheet is a duplex sheet printed only with a side one image, the gate will deflect the sheet into inverter 170, where the sheet will be inverted and then fed to belt 174 for recirculation past transfer station 106 and fuser 116 for receiving and permanently fixing the side two image to the backside of the sheet. Examples of single sheet inverters usable with the present invention are disclosed in U.S. Pat. Nos. 4,918,490; 4,935,786; 4,934,681; and 4,453,841, the disclosures of which are herein incorporated by reference.

The control of all machine functions, including all sheet feeding, is, conventionally, by a machine controller. The controller is preferably a known programmable microprocessor system, as exemplified by extensive prior art, e.g., U.S. Pat. No. 4,475,156 and its references. Plural but interconnecting microprocessors, as shown in FIGS. 5–7, may also be used at different locations. The controller conventionally controls all the machine steps and functions described herein, and others, including the operation of the document feeder, all the document and copy sheet deflectors or gates, the sheet feeder drives, the downstream finishing devices 120, 195, etc. As further taught in the references, the controller also conventionally provides for storage and comparison of the counts of the copy sheets, the number of documents recirculated in a document set, the desired number of copy sets and other selections and controls by the operator through the console or other panel of switches connected to the controller, etc. The controller is also programmed for time delays, jam correction, etc. Conventional path sensors or switches may be utilized to help keep track of the position of the documents and the copy sheets and the moving components of the apparatus by connection to the controller. In addition, the controller variably regulates the various positions of the gates depending upon which mode of operation is selected.

The presently disclosed embodiment indirectly exploits the sheet scheduling techniques of U.S. Pat. Nos. 5,095,342 and 5,159,395. In particular, marking software is employed, in conjunction with one or more controllers, to implement the present sheet scheduling technique. The controllers which control the sheet scheduling described in the present application are Image Output Control 60 and EDN Core 130 of FIGS. 2 and 8, respectively. The majority of the sheet scheduling functions are performed by the EDN Core 130. The Image Output 60 is responsible for converting simplex sheets to duplex with blank back sides. The reason for this difference in responsibility is that the controller 7 needs to know the 'plex of all sheets to prepare the images correctly. Of course, other controller structures are possible depending on the hardware and software used to implement the present embodiment.

The functionality of the marking software is discussed, in some detail, in U.S. patent application Ser. No. 08/010,104, to Hammer et al., entitled "Apparatus and Method for Managing Memory in a Printing System" and filed Jan. 28, 1993, the pertinent portions of which are incorporated herein by reference. As discussed in the Ser. No. '104 Application, with the marking software, the time at which each stored image is to be fed to the photoreceptor 98 (FIG. 3) is designated in a list or table, in advance of marking. As printing proceeds, the scheduling controller refers to the list or table for determining which image should be fetched from disk (FIG. 2); and transmitted to the system memory 61 (FIG. 5), for processing by one of the image generator processors 86. During the scheduling process the scheduling controller may generate gaps (defined by one or more unused pitches) between a set or a job. Moreover, pitches may be intentionally scheduled within the printing of a single set. For example, as discussed in U.S. Pat. No. 5,159,395, in one mode of operation it is preferable to interleaf a pitch between two adjacent sheets on the photoreceptor to facilitate the finishing of multiple sets produced from a stored job.

Referring to FIG. 11, an interposing module (also referred to below as simply "interposer") is designated by the numeral 200. Reference is made to FIG. 3 for understanding the employment of the interposer in the printing system 10. In particular imaged substrate exit the print engine at output nip 202 and enter the finisher 120 by way of an inverting station 204. Additionally, sheets can be fed to the print engine from the high capacity feeder 110, by way of a pair of nips 206. Referring conjunctively to FIGS. 3 and 11, in the preferred embodiment, a print engine side 208 of the interposer is operatively coupled with both the nip 202 and another one of the nips 206 while a finishing side 210 of the interposer is operatively coupled with both the inverting station 204 and one of the nips 206. Further details regarding the coupling of the interposer 200 with the print engine and the finisher will appear below.

Referring still to FIG. 11, the interposer 200 includes a first sheet transport path 214 and second sheet transport path 218. The first sheet transport path communicates with the exit of the print engine and the entrance of the finisher while the second sheet transport path communicates with the high capacity feeder 110 and a sheet feed path 222 of the print engine. In one example, a first sheet tray 224 communicates with the first sheet transport path 214, by way of a first feed path 226, while each of a second sheet tray 228 and a third sheet tray 230 communicate with the first sheet transport path by way of a second feed path 232. Additionally, each of the sheet trays 228, 230 communicate with the second sheet transport path 218 by way of a third feed path 234. In another embodiment, sheet trays 228, 230 are combined structurally to provide high capacity sheet feeding functionality.

As should be appreciated, the interposer is a flexible module which provides a variety of operational modes. In a first mode of operation, the interposer serves as a supplementary feeder for the print engine. More particularly, through use of the third feed path 234 and the second sheet transport path 218 sheets are fed to the print engine from either of sheet trays 228, 230. In a second mode of operation, sheets are added to a stream of imaged substrates exiting the print engine at nip 202. For many cases, operation in the second mode will include adding a "special" sheet, e.g. cover, separator, preprinted or drilled sheet, to the stream of imaged substrates. In a first submode of the second mode of operation, a special sheet is added to either the beginning or end of a selected stream. In some instances, printing productivity will be impaired in that a pitch will have to be skipped in order to accommodate for insertion of a special sheet from one of the sheet trays between sets or jobs.

In a second submode of the second mode of operation a special sheet is interposed between a leading imaged substrate and a trailing imaged substrate of the same job. In one implementation of the second submode, control signals are scheduled in such a way that a leading imaged substrate, a special insertion sheet and a trailing imaged substrate are scheduled respectively to be fed in a first pitch, a second pitch and a third pitch. Accordingly, the printing system losses a pitch as a result of interposing the special sheet between the leading and trailing imaged substrates. While this loss of printing productivity for the second submode cannot always be avoided, at least in some circumstances, as discussed in further detail below, interposing can be accomplished without any loss in productivity. In fact, as will appear, for at least one exemplary case, multiple special sheets can be interposed between a leading imaged substrate and a trailing imaged substrate without any loss in printing productivity.

Referring to FIG. 12, there is provided a flow diagram depicting a scheduling technique in which the feeding of an imagable regular substrate and the feeding of a special sheet can be scheduled in the same pitch. Referring to step 300, upon programming various attributes of a job by way of a dialog, such as the dialog of FIG. 9, the associated job is scheduled with suitable scheduling software. In particular, various signals or identifiers are mapped to respective plex types in a sheet queue of the type shown in FIG. 13. To provide a fuller understanding of the algorithm of FIG. 12, reference will be made to the example of FIG. 13 whenever appropriate.

Initially, at steps 302 and 304 (FIG. 12), a sheet pointer S is set at the first unscheduled identifier in the queue. If it is determined that the first unscheduled identifier does not correspond to a post-fusing insert, via step 306, then the first unscheduled sheet is scheduled, via step 308, to be fed by itself in a single pitch. In the example of FIG. 13, the first sheet is to be handled as a duplex sheet, so the first sheet is scheduled alone.

If, on the other hand, it is determined that the current unscheduled identifier does correspond to a post-fusing insert, via step 306, then the queue is scanned, via step 310, to determine the number of contiguous inserts (i.e. the value of I) associated with the current post-fusing insert. If it is determined, via step 312, that the (S+I)th sheet is not a duplex sheet, then the current sheet S is scheduled alone (step 308). If the (S+I)th sheet is a duplex sheet, but it is determined, via step 314, that I is greater than a preselected reference value, then the current sheet S is scheduled alone (step 308). Referring to FIGS. 3 and 10, in the preferred embodiment, the preselected reference corresponds to the number of pitches defined by a duplex loop.

In one example, the number of pitches defined by the duplex loop is eight. To more fully understand the role of the duplex loop in scheduling, reference is made to the following exemplary scheduling routine:

Sheets: 1,2, . . . ,8,1*d*,2*d*, . . . ,8*d*,9,10, . . . ,16,9*d*,10*d*, . . . 16*d*

Inserts: I1, I2, . . . , I8,

In the above exemplary scheduling routine, sixteen duplex sheets are scheduled to be marked in 32 respective pitches. The size of the duplex loop, in one embodiment is eight pitches, so eight duplex sheets (sixteen sides) are scheduled in order to "fill up" the duplex loop. In the same manner, the next eight duplex sheets (sixteen sides) are scheduled. It should be appreciated that since sides 9–16 do not begin exiting the duplex path, and hence the print engine, until side 9*d* is marked, up to eight inserts can be fed to the first sheet transport path 214 concurrent with the marking of sides 9–16. Accordingly, in the exemplary scheduling routine above, I1 can be scheduled in the same pitch as side 9, 12 can be scheduled in the same pitch as side 10 and so on.

Conversely, if I is greater than eight then not all of the contiguous inserts can be scheduled for the insertion between two sheets. This explains why the process does not proceed to step 316 if I is greater than eight. As will be appreciated by those skilled in the art, the size of the duplex loop could be different from eight without altering the principles upon which the preferred disclosed embodiment is based. As will appear, for those cases in which I is greater than the duplex loop size, each insert will be scheduled in its own individual pitch until I is less than or equal to the duplex loop size.

Referring again to step 314, if I is less than or equal to the duplex loop size, then, at step 316, a duplex sheet feed and an insert feed are scheduled in the same pitch. Subsequently, at step 320, the sheet pointer is incremented and, at step 322, it is determined whether the next sheet S is a post-fusing insert. If the next sheet is a post-fusing insert, then the process loops back to step 312, otherwise the next sheet S is scheduled alone at step 308. Referring to the example of FIG. 13, following the above algorithm would result in sheets 2, 4 being scheduled in the same pitch and sheets 3, 5 being scheduled in the same pitch. Since sheet 6 is simplex, it would be scheduled alone.

Numerous features of the above-disclosed embodiment will be appreciated by those skilled in the art: First, the disclosed embodiment represents an efficient scheduling approach which, under certain circumstance, maximizes machine productivity. In particular, feed signals for a given job are arranged in a queue. Each signal is examined to determine if it is associated with a special sheet to be fed from a special sheet insertion apparatus. When a signal corresponding to a special sheet is encountered, the next signal in the queue corresponding to an imagable regular substrate ("next signal") is examined. If the next signal corresponds with an imagable substrate to be duplexed, then the special sheet and the imagable regular substrate are scheduled to be fed respectively in the special sheet insertion apparatus and in the print engine in the same pitch, provided the number of signals disposed between the signal corresponding to the special sheet and the next signal is no greater than the size of a duplex path in the print engine.

When the signal corresponding to the special sheet and the next signal are scheduled in the same pitch, the special sheet is delivered to an output destination while the imagable regular substrate is being duplexed in a print engine. Additionally, when multiple signals exist between the signal corresponding to the special sheet and the next signal, and when the number of multiple signals is less than the duplex path size, each of the special sheets associated with the multiple signals is delivered to the output destination before the imagable regular substrate corresponding to the next signal is outputted from the print engine.

Second, implementation of the software for the disclosed embodiment is simple yet highly effective. In one example, all of the signals associated with the job are arranged in a sequence. A first pointer pointer (S) is referenced to a first available signal and if the signal relates to one of the special sheets, then a second pointer (S+I) is referenced to the next signal corresponding to an imagable regular substrate. If the imagable regular substrate is scheduled to be duplexed and I is less than or equal to a preselected number, then the special sheet referenced by the first pointer and the imagable regular substrate referenced by the second pointer are scheduled to be fed respectively in the special sheet insertion apparatus and in the print engine in the same pitch. The sequence is traversed with the pair of pointers so that the number of pitches in which the special sheets and imagable regular substrates are fed can be optimized. In this manner, unnecessary pitches are eliminated in the scheduling process.

What is claimed is:

1. In a printing system for producing a print job, the printing system including a print engine for imaging regular substrates, fed to the print engine from a regular substrate feeding apparatus, and delivering the imaged regular substrates as output, the print engine being operatively coupled with a special sheet insertion apparatus, a special sheet insertion path passing by the special sheet insertion apparatus, the special sheet insertion apparatus including one or more special sheets being feedable to the special sheet insertion path and addable to the delivered output of imaged regular substrates, a scheduling apparatus comprising:

a) a memory for storing a set of two or more feed signals, the set of feed signals including a first feed signal and a second feed signal with the first feed signal and the second feed signal corresponding respectively with a special sheet and an imagable regular substrate having opposing sides;

b) a controller for generating the first and second feed signals;

c) said controller communicating with each of the print engine and the special sheet insertion apparatus, each of the special sheet insertion apparatus and the print engine being respectively responsive to the first feed signal and the second feed signal;

d) said controller determining whether the imagable regular substrate is to be imaged on both of the opposing sides; and e) said controller scheduling the first and second feed signals to be transmitted respectively to the special sheet insert apparatus and the print engine during a single pitch, for feeding the imagable regular substrate and the special sheet during the single pitch, when it is determined that the imagable regular substrate is to be imaged on both the opposing sides.

2. The scheduling apparatus of claim 1, wherein the special sheet is delivered to an output destination while a duplex print is produced with the imagable regular substrate.

3. The scheduling apparatus of claim 1, in which it is determined that the imagable regular substrate is to be imaged on only one of the opposing sides, wherein the first feed signal is transmitted to the special sheet insertion apparatus during one pitch and the second feed signal is transmitted to the print engine in another pitch so that the imagable regular substrate and the special sheet are respectively fed to the print engine and the special sheet insertion path during separate pitches.

4. The scheduling apparatus of claim 1, wherein the set of two or more feed signals are part of a sequence of feed signals with the first feed signal being disposed sequentially ahead of the second feed signal.

5. The scheduling apparatus of claim 4, in which the first feed signal corresponds with part of a subsequence of I contiguous electronic sheets where I is an integer and each of the I contiguous electronic sheets corresponds with a special sheet, wherein:

f) a determination is made as to whether I is greater than a preselected value; and g) scheduling is inhibited when it is determined that I is greater than the preselected value.

6. The scheduling apparatus of claim 1, further comprising an interposing module being disposed intermediate of the print engine and a finishing destination, said interposing module including the special sheet insertion apparatus and the special sheet insertion path.

7. A method of scheduling a print job in a printing system, the printing system including a print engine for imaging regular substrates, fed to the print engine from a regular substrate feeding apparatus, and delivering the imaged regular substrates as output, the print engine being operatively coupled with a special sheet insertion apparatus, a special sheet insertion path passing by the special sheet insertion apparatus, the special sheet insertion apparatus including one or more special sheets being feedable to the special sheet insertion path and addable to the delivered output of imaged regular substrates, comprising:

a) generating a set of two or more feed signals, the set of feed signals including a first feed signal and a second feed signal with the first feed signal and the second feed signal corresponding respectively with a special sheet and an imagable regular substrate having opposing sides;

b) determining whether the imagable regular substrate is to be imaged on both of the opposing sides; and c) scheduling the first and second feed signals to be transmitted respectively to the special sheet insert apparatus and the print engine during a single pitch, for feeding the imagable regular substrate and the special sheet during the single pitch, when it is determined, with said b), that the imagable regular substrate is to be imaged on both the opposing sides.

8. The method of claim 7, further comprising delivering the special sheet to an output destination while producing a duplex print with the imagable regular substrate.

9. The method of claim 7, in which it is determined, with said b) that the imagable regular substrate is to be imaged on only one of the opposing sides, further comprising transmitting the first feed signal to the special sheet insertion apparatus during one pitch and transmitting the second feed signal to the print engine in another pitch so that the imagable regular substrate and the special sheet are respectively fed to the print engine and the special sheet insertion path during separate pitches.

10. The method of claim 7, further comprising arranging the feed signals of the set of two or more feed signals into a sequence of feed signals so that the first feed signal is disposed sequentially ahead of the second feed signal.

11. The method of claim 10, in which the first feed signal corresponds with part of a subsequence of I contiguous electronic sheets where I is an integer and each of the I contiguous electronic sheets corresponds with a special sheet, further comprising:

d) determining whether I is greater than a preselected value; and e) inhibiting scheduling, of said c), when it is determined, with said d), that I is greater than the preselected value.

12. The method of claim 7, in which the set of one or more feed signals includes a third feed signal and a fourth feed signal with the third feed signal and the fourth feed signal corresponding respectively with a second special sheet and a second imagable regular substrate having opposing sides, further comprising:

d) determining whether the second imagable regular substrate is to imaged on both of the opposing sides; and e) scheduling the third and fourth feed signals to be transmitted respectively to the special sheet insert apparatus and the print engine during a single pitch, for feeding the second imagable regular substrate and the second special sheet during the single pitch, when it is determined, with said d), that the second imagable regular substrate is to be imaged on both the opposing sides.

13. The method of claim 12, further comprising delivering both the special sheet and the second special sheet to an output destination while producing a duplex print with the imagable regular substrate.

14. A method of scheduling a print job in a printing system, the printing system including a print engine for imaging regular substrates, fed to the print engine from a regular substrate feeding apparatus, and delivering the imaged regular substrates as output, the print engine being operatively coupled with a special sheet insertion apparatus, a special sheet insertion path passing by the special sheet insertion apparatus, the special sheet insertion apparatus including one or more special sheets being feedable to the special sheet insertion path and addable to the delivered output of imaged regular substrates, comprising:

a) generating a set of two or more feed signals, the set of feed signals including a first type of feed signal and a second type of feed signal with the first type of feed signal and the second type of feed signal corresponding respectively with a set of special sheets and a set of imagable regular substrates, each of the imagable regular substrates having opposing sides;

b) referencing a first pointer to a first one of the feed signals and a second pointer to a second one of the feed signals;

c) determining whether the feed signal referenced by the first pointer is a first feed signal type and whether the feed signal referenced by the second pointer is a second feed signal type; and d) scheduling the feed signal referenced by the first pointer and the feed signal referenced by the second pointer to be transmitted respectively to the special sheet insert apparatus and the print engine during a single pitch, for feeding one of the imagable regular substrates and one of the special sheets during the single pitch, when it is determined, with said c), that the feed signal referenced by the first pointer is a first feed signal type and the feed signal referenced by the second pointer is a second feed signal type.

15. The method of claim 14, further comprising:

referencing the first pointer to a third one of the two or more feed signals and the second pointer to a fourth one of the two or more feed signals; and repeating c) and d) for the third and fourth ones of the two or more feed signals.

16. The method of claim 14, in which, the feed signals of the set of feed signals are arranged in a sequence with the first one of the feed signals being sequentially ahead of the second one of the feed signals, the first one of the feed signals is of the first feed signal type and is assigned a value of S where S is an integer, the second one of the feed signals is of the second feed signal type and is assigned a value of (S+I) where I is an integer, and each of the (I–1) feed signals sequentially disposed between the first one of the feed signals and the second one of the feed signals is of the first feed signal type, comparing the value of I to a preselected reference; and inhibiting said scheduling of said d) when the value of I is greater than the preselected reference.

* * * * *